US007937017B2

(12) United States Patent
Mori

(10) Patent No.: US 7,937,017 B2
(45) Date of Patent: May 3, 2011

(54) IMAGE FORMING APPARATUS

(75) Inventor: Hirotaka Mori, Ichinomiya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 1167 days.

(21) Appl. No.: 11/614,544

(22) Filed: Dec. 21, 2006

(65) Prior Publication Data

US 2007/0147903 A1 Jun. 28, 2007

(30) Foreign Application Priority Data

Dec. 27, 2005 (JP) ..... 2005-374717
Nov. 22, 2006 (JP) ..... 2006-315915

(51) Int. Cl.
*G03G 15/16* (2006.01)

(52) U.S. Cl. ..... 399/101

(58) Field of Classification Search ..... 399/123, 399/101; 15/256.52
See application file for complete search history.

(56) References Cited

U.S. PATENT DOCUMENTS 4,989,047 A * 1/1991 Jugle et al. ..... 399/349
5,444,522 A * 8/1995 Owens, Jr. ..... 399/123
5,493,383 A * 2/1996 Pozniakas et al. ..... 399/345

FOREIGN PATENT DOCUMENTS

JP 9152788 6/1997
JP 9156794 6/1997
JP 2001147564 5/2001

* cited by examiner

*Primary Examiner* — David P Porta
*Assistant Examiner* — Bryan P Ready
(74) *Attorney, Agent, or Firm* — Banner & Witcoff, Ltd.

(57) ABSTRACT

The belt cleaning unit receives a biasing force, receives a rotating force of an output gear connected to an input gear, and further receives a reaction force from a cleaning roller rotationally driven to be opposed to a transfer belt while in contact with it during a cleaning operation, thus the belt cleaning unit is pressed against a front wall of a front side support member.

14 Claims, 10 Drawing Sheets

IMAGE FORMING APPARATUS

CROSS REFERENCE TO RELATED APPLICATION

This application claims priority from Japanese Patent Application No. 2005-374717 filed Dec. 27, 2005 and Application No. 2006-315915 filed Nov. 22, 2006. The entire content of these priority applications is incorporated herein by reference.

TECHNICAL FIELD

The present invention relates to an image forming apparatus.

BACKGROUND

Image forming apparatuses, such as laser printers, have utilized endless belts as conveyance mechanisms for moving paper, and intermediate transfer mechanisms for conveying developer images transferred from photosensitive drums. In such image forming apparatuses, belt cleaning devices using rollers and brushes are generally included to remove extraneous matters (residual toner, paper powder and the like) on the belts. For example, Japanese Patent Laid-open No.9-152788 discloses a cleaning roller in pressure contact with the surface of a belt and a cleaning blade to be in pressure contact with the outer surface of the cleaning roller. The cleaning roller is rotationally driven. The cleaning roller physically scrapes off an extraneous matter on the belt, and the cleaning blade scrapes off the extraneous matter transferred to the cleaning roller.

SUMMARY

Incidentally, in the image forming apparatus including a belt cleaning device as described above, the useful lives of, for example, the cleaning roller and the other members (for example, the above described belt) in the image forming apparatus differ, and therefore, it is desirable to make only the belt cleaning device individually replaceable. In this case, the belt cleaning device is disposed inside the image forming apparatus body independently from the belt, and if the cleaning roller is displaced with respect to the belt, there is the fear of having an adverse effect on traveling of the belt, and reducing cleaning accuracy. Accordingly, the cleaning device has to be positioned to the image forming apparatus body with high accuracy. An image forming apparatus includes an apparatus body including an opening, a belt which is disposed inside the apparatus body and is moveable therein, a power supply circuit generating bias voltage, an output terminal which is provided inside the apparatus body and aids in the transfer of a bias voltage of the power supply circuit, a belt cleaning unit constructed to be attachable to and detachable from the apparatus body via the opening, and the belt cleaning unit having an input terminal positioned at a first end side of the belt cleaning unit and a cleaning member, wherein the input terminal is in electrical contact with the output terminal, wherein apparatus body further includes an opposing part which is positioned at a side opposite to the output terminal and a biasing mechanism which applies a biasing force to elastically hold the cleaning unit between the opposite part and the output terminal.

For example, when the belt cleaning unit is constructed to be supported with a support member fixedly disposed inside the apparatus body, in order to make the belt cleaning unit attachable and detachable, a certain degree of clearance is required between the belt cleaning unit and the support member. Accordingly, the belt cleaning unit becomes unstable inside the apparatus body. Meanwhile, in the construction in which bias voltage is supplied to the belt cleaning unit, in order to obtain reliable electric connection of the output terminal connected to the power supply voltage generating bias voltage and the input terminal of the belt cleaning unit, a certain degree of contact pressure originally has to be secured between both of them. Thus, by utilizing the biasing force (elastic force) for ensuring the contact pressure of the input terminal and the output terminal, the belt cleaning unit can be positioned without backlash.

"Belt" can include a conveyor belt which conveys a recording medium (not limited to a paper recording medium such as paper, but may be a recording medium or the like of a plastic such as an OHP sheet), an intermediate transfer belt to which a developer image is transferred, a photosensitive belt as an image carrier and the like.

"An extraneous matter" can include a developer, paper powder and the like.

"Image forming apparatus" is not only a printing apparatus such as a printer (for example, a laser printer), but also can be a facsimile, and a multifunctional machine including a printer function and reading function (scanner function) and the like. The image forming apparatus is not limited to a tandem (single path) type including an image carrier for each development unit, but can be four cycle (single drum) type in which each development unit performs development for a common image carrier, if only it has the above described belt. Further, it can be either of a direct transfer type which directly transfers a developer image to a recording medium, or of an intermediate transfer type which indirectly transfers the developer image via an intermediate transfer belt.

An image forming apparatus according to another aspect of the present invention includes an apparatus body including an opening, a belt positioned inside the apparatus body and is moveable therein, an output gear which is provided inside the apparatus body and is rotationally driven by a drive force and a belt cleaning unit provided to be attachable to and detachable from the apparatus body via the opening, wherein the belt cleaning unit further comprising a cleaning roller which is capable of being in contact with the belt and an input gear which is capable of being connected to the output gear and rotationally drives the cleaning roller and wherein the apparatus body further including an opposing part which is disposed inside the apparatus body, and is in contact with the belt cleaning unit while receiving a force applied to the belt cleaning unit via the input gear by the drive force of the output gear.

Accordingly the belt cleaning unit can be positioned without backlash by the force which the input gear receives by the drive force from the output gear and the abutting force on the opposing part.

An image forming apparatus according to another aspect of the present invention includes an apparatus body having a unit housing, a belt which is disposed inside the apparatus body and is moveable therein, a belt cleaning unit which has a case and a cleaning roller supported by the case, and cleans the belt, wherein the belt cleaning unit constructed to be attachable to and detachable from the unit housing.

According to the present invention, the cleaning roller can be replaced independently even if the replacement time differs from that of the other components in the image forming apparatus.

Also, another embodiment according to the present invention can include an image forming apparatus including an apparatus body having a unit housing part, a belt provided inside the apparatus body and provided to be capable of revolving movement, and a cleaning unit which has a case and a cleaning roller supported by the case, the cleaning unit capable of cleaning the belt, further wherein the cleaning unit is housed in the unit housing part to be attachable and detachable.

Thus, in embodiment of the present invention, the cleaning roller can be replaced independently even if the replacement time differs from that of the other components in the image forming apparatus.

Another embodiment according to the present invention include an image forming apparatus wherein the unit housing part includes an output gear which rotates by receiving a drive force, wherein the belt cleaning unit includes an input gear which is gear-connected to the output gear to rotationally drive the cleaning roller, and wherein a first force applied to the belt cleaning unit via the input gear by a drive force of the output gear, and a second force which presses the belt cleaning unit against the support part are directed in substantially the same direction.

According to this embodiment of the present invention, reduction in a positioning force of the belt cleaning unit in the unit housing part can be suppressed by the drive force of the output gear. The above term "substantially the same direction" does not always have to be completely the same direction as long as the above described second force does not interfere first force.

According to another embodiment of the present invention, the image forming apparatus can include a unit housing part is provided with a first output terminal via a first biasing member, and is provided with a second output terminal via a second biasing member. Further, the case of the belt cleaning unit includes a metal roller which is in contact with the cleaning roller, a first input terminal electrically connected to the cleaning roller and elastically in contact with the first output terminal by a biasing force of the first biasing means, a second input terminal electrically connected to the metal roller and elastically in contact with the second output terminal by a biasing force of the second biasing means, where a composite force including a third force which the first input terminal receives from the first output terminal, and a fourth force which the second input terminal receives from the second output terminal, and the second force which presses the belt cleaning unit against the support part are directed in substantially the same direction.

According this embodiment of the present invention, reduction in the positioning force of the belt cleaning unit in the unit housing part can be suppressed by the biasing forces of the first biasing means and the second biasing means.

The above described "substantially the same direction" does not always have to be completely the same direction, as long as the second force does not interfere with the above described composite force.

BRIEF DESCRIPTION OF THE DRAWINGS

Illustrative aspects in accordance with the invention will be described in detail with reference to the following figures wherein.

DETAILED DESCRIPTION

An illustrative aspect of the present invention will be described with reference to FIGS. 1 to 10.

Figure 1:
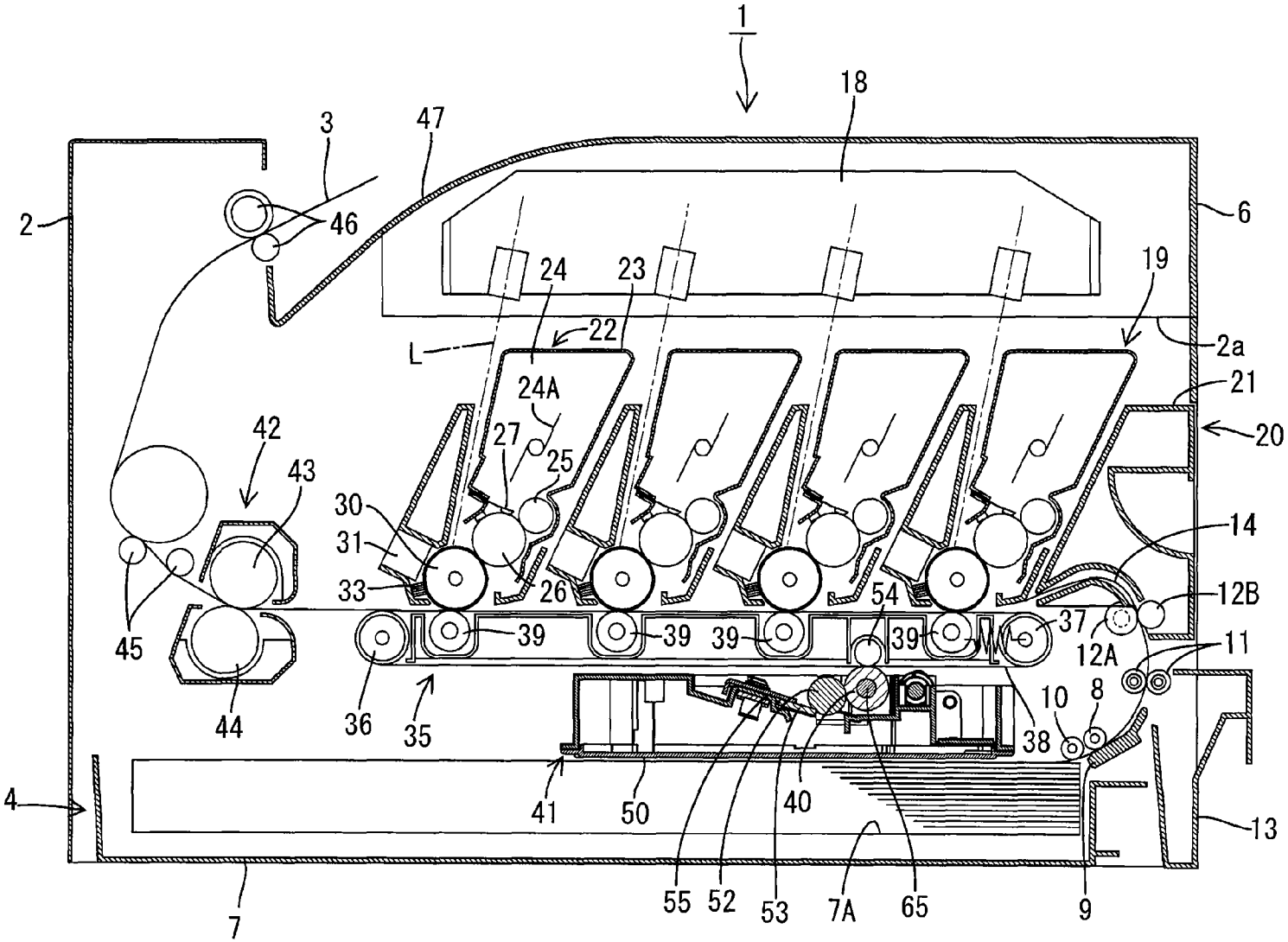
FIG. 1 is a side sectional view showing a schematic construction of a laser printer according to one aspect of the invention.

FIG. 1 is a side sectional view showing a schematic construction of a laser printer 1 as an image forming apparatus of this illustrative aspect. The laser printer 1 is a so-called direct tandem type color laser printer including four photosensitive drums 30 corresponding to respective colors of, for example, black, cyan, magenta and yellow. In a body casing 2 (one example of "an apparatus body") of the laser printer 1, a paper feeding part 4 for feeding paper 3 as a recording medium, a scanner part 18 which exposes the above described photosensitive drum 30, an image forming unit 20 for forming an image on the fed paper 3, a paper conveying part 35 which conveys the paper 3 to the image forming unit 20, a belt cleaning unit 41 as a belt cleaning device and the like are included. In this illustrative aspect, the paper conveying part 35 is attachable and detachable from a later-described opening 2*a* of the body casing 2 as a belt unit, and the belt cleaning unit 41 is also attachable and detachable from the opening 2*a*. Note that in the following description, the right side of the paper surface in FIG. 1 is set as "front, front side" of the laser printer 1.

(1) Paper Feeding Part

The paper feeding part 4 includes a paper feeding tray 7 as a supply tray attachably and detachably mounted on a bottom portion inside the body casing 2, a separation roller 8 and a separation pad 9 positioned above a front end portion of the paper feeding tray 7, a pickup roller 10 positioned behind the separation roller 8, a pair of paper powder removing rollers 11 and 11 disposed above the front side of the separation roller 8, and a pair of registration rollers 12A and 12B positioned above the paper powder removing rollers 11 and 11.

The paper feeding tray 7 forms a shallow box shape with its top face opened to allow the paper 3 for forming an image to be stacked therein. A front wall 13 positioned at a front end portion of the paper feeding tray 7 is disposed at the lower side of a front cover 6 in the front surface of the body casing 2, and by pulling the front wall 13 to the front side, the paper feeding tray 7 can be horizontally drawn out forward of the body casing 2. A paper pressing plate 7A on which the paper 3 is mountable in a stacked state is positioned on a bottom surface of the paper feeding tray 7, and the paper pressing plate 7A is rotatably supported at a rear end portion, and is biased in the upward direction at the front end portion by a spring not shown. Thereby, the paper 3 stacked in the paper feeding tray 7 is in the state in which its front end side is biased upward.

The paper 3 on the uppermost position of the paper feeding tray 7 is pressed toward the pickup roller 10 by the biasing force of the paper pressing plate 7A, and is started to be conveyed toward a position between the separation roller 8 and the separation pad 9 by the rotation of the pickup roller 10. Then, the paper 3 is handled one by one when caught between the separation roller 8 and the separation pad 9, and is fed by the rotation of the separation roller 8. The separated paper 3 is conveyed to the registration rollers 12A and 12B, after the paper powder removing roller 11 removes paper powder or dust thereon.

The registration rollers 12A and 12B are constructed by the drive roller 12A and the follower roller 12B, and convey the paper 3 after resisting it to turn it onto a transfer belt (paper conveying belt) 38 of the paper conveying part 35 which will be described later via a paper feed path 14 forming a U shape which is folded to the rear from the front.

(2) Scanner Part

A scanner part 18 as exposure means is positioned at the uppermost portion inside the body casing 2. The scanner part 18 irradiates a laser light L based on a predetermined image data onto the surface of the corresponding photosensitive drum 30 with high-speed scanning. Four laser lights L corresponding to the respective colors are emitted diagonally downward from a bottom surface of the scanner part 18. The optical paths of the respective laser lights L are disposed with constant distances spaced longitudinally from one another in parallel with one another.

(3) Image Forming Unit

Above the paper feeding tray 7 in the front of the body casing 2, the opening 2*a* is formed so as to be openable and closable by the front cover 6 pivotally supported at the lower end portion. In the body casing 2, a unit housing 19, which communicates with the opening 2*a* at the lower side of the scanner part 18, is positioned, and the image forming unit 20 which is capable of being drawn forward and attachable and detachable is housed in the unit housing 19. The image forming unit 20 includes a frame 21, and in this frame 21, the drums 30 as image carriers, which can be photosensitive drums, chargers 31 as charging means, which can be scorotron chargers, four development cartridges 22 as developing devices, and cleaning brushes 33 are held. Since these constructions corresponding to the respective colors of black, cyan, magenta and yellow are all of the same structures, reference numerals are assigned to only the one at the left end of the paper surface, and those of the others are omitted in FIG. 1.

The four development cartridges 22 are mounted to be attachable to and detachable from the frame 21, and respectively correspond to the respective colors of black, cyan, magenta and yellow. The development cartridge 22 includes a box-shaped housing case 23 with a lower side opened, and a toner housing chamber 24 in which a toner T (polymerized toner, developer), which can include one nonmagnetic component with positive electrostatic property of each color, is formed at an upper portion inside the housing case 23. An agitator 24A is positioned in the toner housing chamber 24, and the agitator 24A is rotationally driven by input of the drive force from a motor not shown, thereby agitating the toner T therein. At a lower side of the toner housing chamber 24, a supply roller 25, a development roller 26 as a developer carrier and a thickness restricting blade 27 are positioned.

The supply roller 25 is rotatably supported at the housing case 23 of the development cartridge 22, and can be constructed by covering a roller shaft of a metal with a roller formed by a conductive foamed material. The supply roller 25 is rotationally driven by input of the drive force from a motor not shown.

The development roller 26 is rotatably supported at the housing case 23 of the development cartridge 22 in the state in which it is in contact with the supply roller 25 in such a manner as to be compressed by each other, in a diagonally lower rear side of the supply roller 25. The development roller 26 is in contact with the photosensitive drum 30 to be opposed to it in the state in which the development cartridge 22 is mounted on the frame 21. The development roller 26 can be constructed by covering a roller shaft of a metal with a roller body formed by conductive urethane rubber or silicon rubber including fine carbon particles. A coat layer of urethane rubber or silicon rubber containing fluorine can be coated on the surface of the roller body. Developing bias is applied to the development roller 26 at the time of development. The development roller 26 is rotationally driven by input of the drive force from a motor not shown.

The thickness restricting blade 27 includes a pressing portion semicircular shape in section formed by insulating silicon rubber at a tip end portion of the blade body formed by a metal plate spring material. The thickness restricting blade 27 is supported at the housing case 23 above the development roller 26, and the pressing portion is in pressure contact with the development roller 26 by an elastic force of the blade body.

At the time of development, the toner T released from the toner housing chamber 24 is supplied to the development roller 26 by the rotation of the supply roller 25, and at this time, it is triboelectrically charged to positive polarity between the supply roller 25 and the development roller 26. The toner T supplied onto the development roller 26 advances into between the thickness restricting blade 27 and the development roller 26 with the rotation of the development roller 26, where it is triboelectrically charged sufficiently, and is carried on the development roller 26 as a thin layer of a uniform thickness.

The photosensitive drum 30 is formed into a cylindrical shape and includes a drum body of a metal which is grounded, and can be constructed by covering its surface layer with a photosensitive layer of a positive electrostatic property made of polycarbonate or the like. The photosensitive drum 30 is positioned rotatably around a drum shaft by the drum shaft of a metal as the shaft, which extends along a longitudinal direction of a drum body in an axial center of the drum body, being supported at the frame 21. The photosensitive drum 30 is rotationally driven by input of the drive force from a motor not shown.

The scorotron type charger 31 is disposed to be opposed to the photosensitive drum 30 spaced at a predetermined distance so as not to be in contact with the photosensitive drum 30, at a diagonally rear side above the photo sensitive drum 30. The scorotron type charger 31 uniformly charges the surface of the photosensitive drum 30 to positive polarity, by causing corona discharge from a charging wire of tungsten or the like.

The cleaning brush 33 is disposed at the rear side of the photosensitive drum 30 to be opposed to and in contact with the photosensitive drum 30.

The surface of the photosensitive drum 30 is uniformly charged positively to, for example, +900 V by the scorotron charger 31 first at the time of its rotation. Thereafter, it is exposed by high-speed scanning of the laser light from the scanner part 18 so that the surface potential is partially made, for example, +100 V, whereby an electrostatic latent image corresponding to the image to be formed on the paper 3 is formed thereon.

Next, by rotation of the development roller 26, the toner T which is carried on the development roller 26 and is positively charged to, for example, +450 V is supplied to the electrostatic latent image formed on the surface of the photosensitive drum 30 when it is opposed to and in contact with the photo sensitive drum 30. Thereby, the electrostatic latent image of the photosensitive drum 30 is converted into a visible image, and the toner image (developer image) by the reversal development is carried on the surface of the photosensitive drum 30.

Thereafter, the toner image carried on the surface of the photosensitive drum 30 is transferred to the paper 3 by transfer bias (for example, −700 V) of negative polarity which is applied to the transfer roller 39 while the paper 3 (conveyed by the later-described transfer belt 38) passes through the transfer position between the photosensitive drum 30 and the transfer roller 39. The paper 3, to which the toner image is thus transferred, is conveyed to a fuser 42 next.

(4) Paper Conveying Part

The paper conveying part 35 is disposed under the image forming unit 20 mounted on the unit housing 19. The paper conveying part 35 can include a pair of belt supporting rollers 36 and 37 positioned with spaces at the rear side and the front side to be parallel with each other, and a transfer belt 38 (one example of "a belt") looped over both the rollers 36 and 37. The transfer belt 38 circulates (revolves) by the belt supporting roller 36 at the rear side being rotationally driven by the drive force of the motor. The belt supporting roller (drive roller) 36 at the rear side can be a roller formed by covering a substantially cylindrical metal tube material surface of aluminum or stainless steel with a rubber layer, or applying a coating layer to it, for securing a gripping force with the belt inner surface. The belt supporting roller (tension roller) 37 at the front side is a roller that can be formed by applying plating to a substantially cylindrical metal tube material surface of aluminum or stainless steel for prevention of abrasion of the surface due to friction with the belt inner surface. The transfer belt 38 is an endless belt made of a resin material of, for example, of polycarbonate or the like, and its width dimension is not less than the width dimension of the maximum printable paper size (for example, A4 size in this illustrative aspect).

At the inner side of the transfer belt 38, the four transfer rollers 39, which are disposed to be opposed to the respective photosensitive drums 30 of the aforementioned image forming unit 20, are aligned at constant spaces in the longitudinal direction. Transfer belt 38 is positioned or in moveable contact between the respective photosensitive drums 30 and the corresponding transfer rollers 39. Each of the transfer rollers 39 is constructed by covering an elastic member formed by a conductive rubber material around a roller shaft of a metal, so that transfer bias of negative polarity is applied thereto at the time of transfer. A belt cleaning unit 41 having a cleaning roller 40 for removing extraneous matters such as the residual toner T and paper powder adhering onto the transfer belt 38 (explanation may be made with the residual toner T cited as a representative example in the following description), is positioned at the lower side of the transfer belt 38. The paper 3 which is fed out from the aforementioned resist rollers 12A and 12B passes through the paper feed path 14, abuts on a portion in the vicinity of the front end of the top surface of the transfer belt 38, where it is electrostatically attracted to the top surface of the transfer belt 38, and is conveyed rearward with circulating movement of the transfer belt 38.

(5) Fuser

The fuser 42 is disposed behind the paper conveying part 35 in the body casing 2. The fuser 42 is constructed by a heating roller 43, and a pressure roller 44 or the like which are positioned opposite to each other, and fuses the toner image transferred onto the paper 3 to the paper surface by heat. The paper 3 subjected to heat fusing is conveyed to a paper discharge roller 46 disposed at an upper portion of the body casing 2 by the conveying rollers 45 disposed at a diagonally rearside above the fuser 42. A paper discharge tray 47 with its front end side substantially horizontal and its rear end side inclined downward to the rear is positioned on a top surface of the body casing 2, and the paper 3 after image formation which is discharged from the paper discharge roller 46 is stacked on the paper discharge tray 47.

<Construction of Belt Cleaning Unit>

Figure 2:
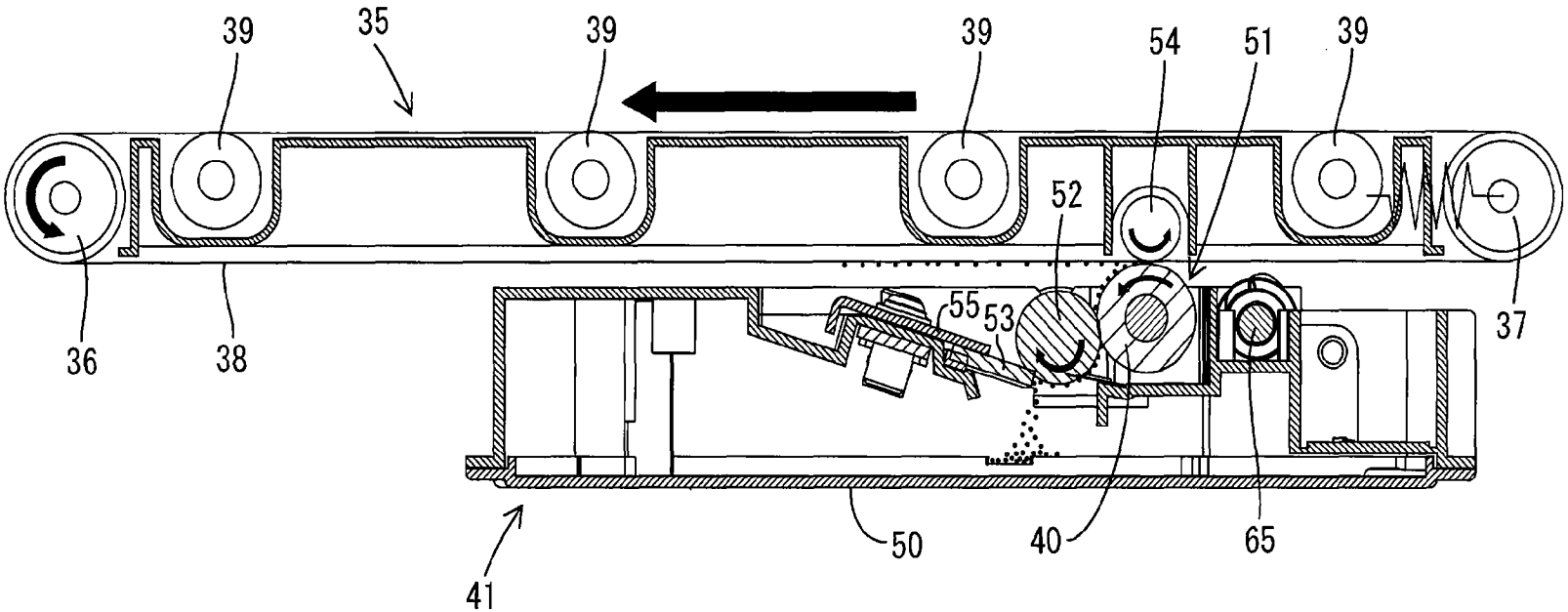
FIG. 2 is a side sectional view showing a paper conveying part and a belt cleaning part by enlarging them.

FIG. 2 is an enlarged side sectional view showing the paper conveying part 35 and the belt cleaning unit 41.

The belt cleaning unit 41 includes a box-shaped case 50 slim and long in the longitudinal direction, and the case 50 is positioned at the lower side of the transfer belt 38. In this case 50, an opening 51 is formed at a front end side of a top surface, and the cleaning roller 40 as a cleaning member is rotatably positioned inside the opening 51. The cleaning roller 40 is a silicon foamed roller which can be constructed by covering a roller shaft of a metal with a roller body formed by a conductive foamed material.

For example, a metal roller 52 (one example of "metalroller") formed by a hard material such as a metal is rotatably positioned at a diagonally lower rear side of the cleaning roller 40 so as to be in pressure contact with the cleaning roller 40.

Further, a scraping blade 53, or a scraping member, can be made of rubber and be positioned at a lower side of the metal roller 52. Scraping blade 53 further includes a rear end portion which is connected to a holder 55, or a holding member, which can be made of metal. Further, scraping blade 53 includes a front end portion which is a free end is in pressure contact with a lower surface of the metal roller 52 by an elastic force of the blade body. In order to bring scraping blade 53 into contact with the metal roller 52 with a uniform force over the substantially entire length in the longitudinal direction, the rear end portion of the scraping blade 53 is fixed with a force which is strong. To achieve this substantially uniform force, holder 55 can be made of a metal with relatively high strength. Further, a backup roller 54 formed by a conductive member such as a metal is rotatably positioned above the cleaning roller 40 with the transfer belt 38 vertically nipped between the backup roller 54 and the cleaning roller 40.

As shown in FIG. 2, at the time of a cleaning operation which is carried out during the period before the paper 3 is discharged by the paper discharge roller 46 (after, for example, the paper 3 with an image formed thereon passes through the fuser 42), the cleaning roller 40 is rotationally driven. Cleaning roller 40 can be driven in a direction opposed to the transfer belt 38 circulating in the counterclockwise direction in the drawing in the contact surface with it (that is, in the counterclockwise direction in the drawing), by the drive force from a motor not shown. Also, at the same time, the metal roller 52 is rotationally driven in the clockwise direction in the drawing. Meanwhile, the backup roller 54 rotates together in the counterclockwise direction in the drawing with the circulation movement of the transfer belt 38.

The roller shaft of the backup roller 54 is grounded, and at the time of a cleaning operation, negative polarity bias of (one example of "bias voltage"), for example, −3 kV is applied to the cleaning roller 40. Further, a negative polarity bias (one example of "bias voltage") of, for example, −3.5 kV is applied to the metal roller 52. Thereby, the residual toner T adhering to the transfer belt 38 moves to the cleaning roller 40 by a bias attraction force and a contact force of the cleaning roller 40 at a region in the vicinity of the opposing position of the cleaning roller 40 and the backup roller 54. The residual toner T carried by the cleaning roller 40 moves to the hard metal roller 52 by the bias attraction force, and the residual toner T carried by the metal roller 52 is scraped by the scraping blade 53, and finally collected into the case 50.

<Pressing Force Changing Mechanism of Backup Roller to Cleaning Roller>

In the laser printer 1 of this illustrative aspect, a pressing force changing mechanism 60 is included, which causes the pressing force of the backup roller 54 to the cleaning roller 40 to differ at the time of the above described cleaning operation and at the time of the non-cleaning operation. More specifically, the pressing force changing mechanism 60 positions the backup roller 54 at a separation position separated from the transfer belt 38 during the image formation time (non-cleaning operation time) in which, for example, a start command for image formation is initiated. As the paper 3 is moved onto the transfer belt 38 from the paper feeding tray 7, a toner image is transferred onto the paper 3, and the toner image is fused by heat with the fuser 42. On the other hand, during a cleaning operation, force charging mechanism 60 positions the backup roller 54 into contact with the transfer belt 38 , so that the transfer belt 38 is also positioned into contact with the cleaning roller 40. Namely, this illustrative aspect has the construction in which the backup roller 54 is pressed against the cleaning roller 40 to ensure the pressure required for cleaning only during a cleaning operation. Thus, even in a configuration which is always rotationally driven during a cleaning operation and also during a non-cleaning operation, there is no fear of applying travel load to the transfer belt 38. As a matter of course, the backup roller 54 does not always have to be moved to the position completely separated from the transfer belt 38 during a non-cleaning operation, and it may be in light contact with the transfer belt 38 within the range in which travel of the transfer belt 38 is not hindered. In short, if a travel load to the transfer belt 38 can be reduced, as compared to the travel load during cleaning operation, contact is suitable during a non-cleaning operation.

Figure 3:
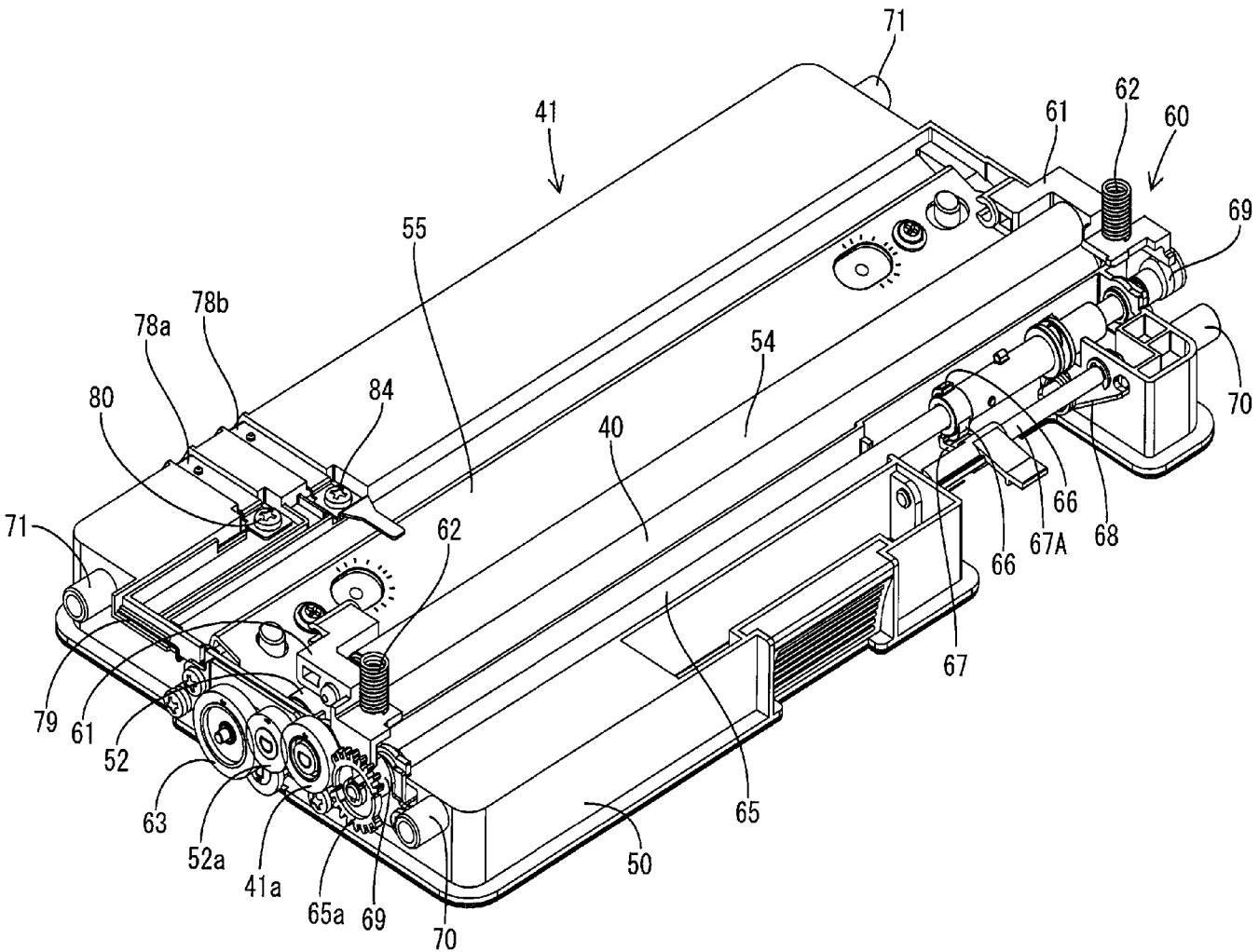
FIG. 3 is a perspective view showing a belt cleaning unit and a pressing force changing mechanism.
Figure 4:
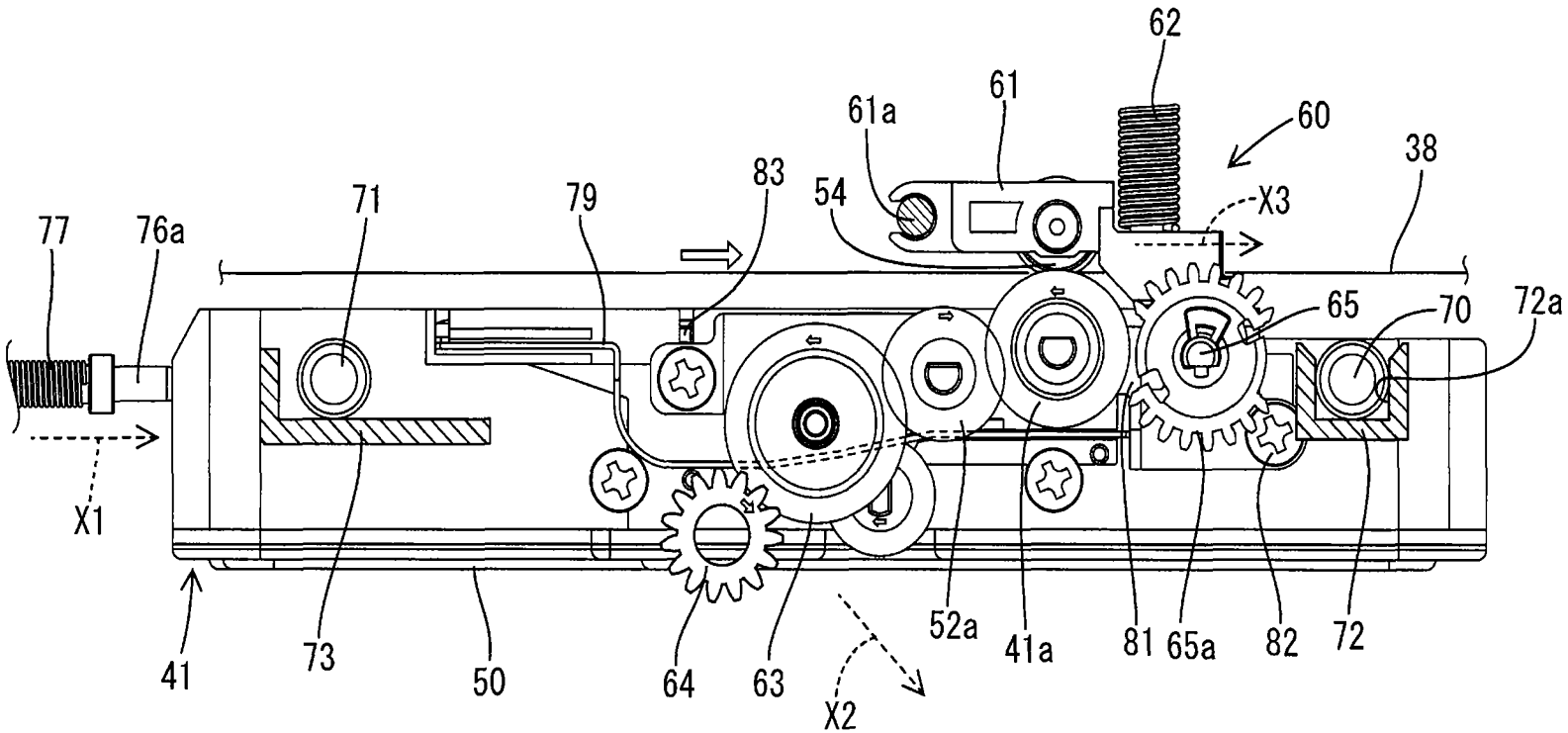
FIG. 4 is a left side view showing the belt cleaning unit and the pressing force changing mechanism.

FIG. 3 is a perspective view showing the belt cleaning unit 41 and the pressing force changing mechanism 60 (the front side of the laser printer 1, or the opening 2*a* side of the body casing 2, is in the lower right direction of the paper surface of the drawing). FIG. 4 is a left side view showing the belt cleaning unit 41 and the pressing force changing mechanism 60, and the front side of the laser printer 1 (the opening 2*a* side of the body casing 2) is in the right direction of the paper surface of the drawing. The hollow arrow in the drawing indicates the rotational direction of each gear.

As shown in FIG. 3, the backup roller 54 is rotatably held by a pair of moveable holding arms 61 and 61 which are respectively disposed at both of its left and right ends. As shown in FIG. 4 each of the moveable holding arms 61 has a front end portion made moveable up and down around a rear end portion pivotally supported at a support shaft body 61*a* which is parallel with the backup roller 54 and positioned at the body casing 2 side. Each of the moveable holding arms 61 has its rocking end portion (front end portion) pressed downward (the belt cleaning unit 41 side) by a pressing spring 62 as a biasing mechanism. In FIG. 3, the backup roller 54, a pair of moveable holding arms 61 and pressing springs 62 are mounted on the paper conveying part 35 constructed as a belt unit (but the transfer belt 38 is omitted in the drawing for convenience to facilitate understanding).

The cleaning roller 40 has both end portions of its roller shaft bore positioned to protrude from a left and a right wall of the case 50, and a rotary gear 41*a* is integrally positioned at one of the end portions (for example, the left end portion). The metal roller 52 has both end portions of its roller shaft bore positioned to protrude from the left and right wall of the case 50, and a rotary gear 52*a* is integrally positioned at one of the end portions (for example, the left end portion) and is meshed with the above described rotary gear 41*a* to be gear-connected thereto. An input gear 63 is positioned behind the rotary gear 52*a*, the input gear 63 is meshed with the rotary gear 52*a* to be gear-connected thereto, and is meshed with an output gear 64 at the body casing side in the state in which the belt cleaning unit 41 is mounted in the body casing 2. The output gear 64 is disposed at a diagonally lower rear side of the input gear 63, and is rotationally driven by receiving the drive force from a motor not shown. The motor rotates by a start command for image formation, for example, and the drive force is transmitted to the rotary gear 41*a* and the rotary gear 52*a* via the output gear 64 and the input gear 63, thereby rotationally driving the cleaning roller 40 and the metal roller 52.

A metal shaft body 65 as a rotary shaft body which is parallel with the cleaning roller 40 and has both end portions positioned to protrude from the left and right wall of the case 50 is positioned in front of the cleaning roller 40. The metal shaft body 65 includes a gear 65*a* having a pair of tooth portions symmetrically disposed is integrally positioned at one of the end portions (for example, the left end portion) of the metal shaft body 65. A pair of protruded portions 66 and 66 are disposed symmetrically about the shaft center at a position near to a center in the metal shaft body 65. A rotary shaft body 67A parallel with the metal shaft body 65 is positioned in front of the metal shaft body 65, and an engaging arm 67 is integrally positioned at the rotary shaft body 67A. When the tooth portions of the gear 65*a* are at the rotation position opposed to the rotary gear 41*a*, a claw at a tip end of one end portion (end portion facing the rear side in FIG. 3) of the engaging arm 67 is engaged with one of a pair of protruded portions 66 and 66. The engaging arm 67 is caused to abut on a solenoid switch (not shown) at the other end portion (end portion facing to the front side in FIG. 3), so that when the solenoid switch receives a start command signal for an image forming operation or a start command signal for the cleaning operation, the solenoid switch performs an ON operation to release engagement of the engaging arm 67 and the protruded portion 66. When the engagement is released, the metal shaft body 65 is forcefully rotated to the position where the tooth portion of the gear 65*a* is meshed with the rotary gear 41*a* by a coil spring 68 as a biasing spring.

Further, the metal shaft body 65 is integrally provided with a pair of cams 69 and 69 having larger end portions (the left side is at the inner side of the gear 65*a*) respectively. In the state in which the belt cleaning unit 41 is mounted in the body casing 2 and the above described paper conveying part (belt unit) 35 is further mounted thereon, the end portions of the pair of moveable holding arms 61 and 61 are positioned on the peripheral surfaces of the pair of cams 69 and 69.

Next, the operation of the pressing force changing mechanism 60 will be described with reference to schematic views shown in FIGS. 5 and 6 in addition to FIGS. 3 and 4.

FIG. 3 shows the state in which each of the cams 69 has its large diameter portion faced upward, the tooth portions of the gear 65*a* are in the rotational position where they are opposed to the rotary gear 41*a* and are not meshed with it, and the metal shaft body 65 is held by the engaging arm 67. In this state, as shown in FIG. 5, the rocking end portions of the moveable holding arms 61 and 61 located at both left and right sides of the transfer belt 38 and placed on the large diameter portions of the respective cams 69 are pushed upward against the biasing force of the pressing springs 62, and thereby, the backup roller 54 is placed at the above described separation position. At this time, the transfer belt 38 is in the separation state such that the cleaning roller 40 and the backup roller 54 separated from each other, when such cleaning pressure is not applied. At this time, even if the transfer belt 38 is in contact with the cleaning roller 40 which rotates in the counterclockwise direction in the drawing, the cleaning pressure is not applied thereto, and therefore, a cleaning operation is not performed.

Figure 5:
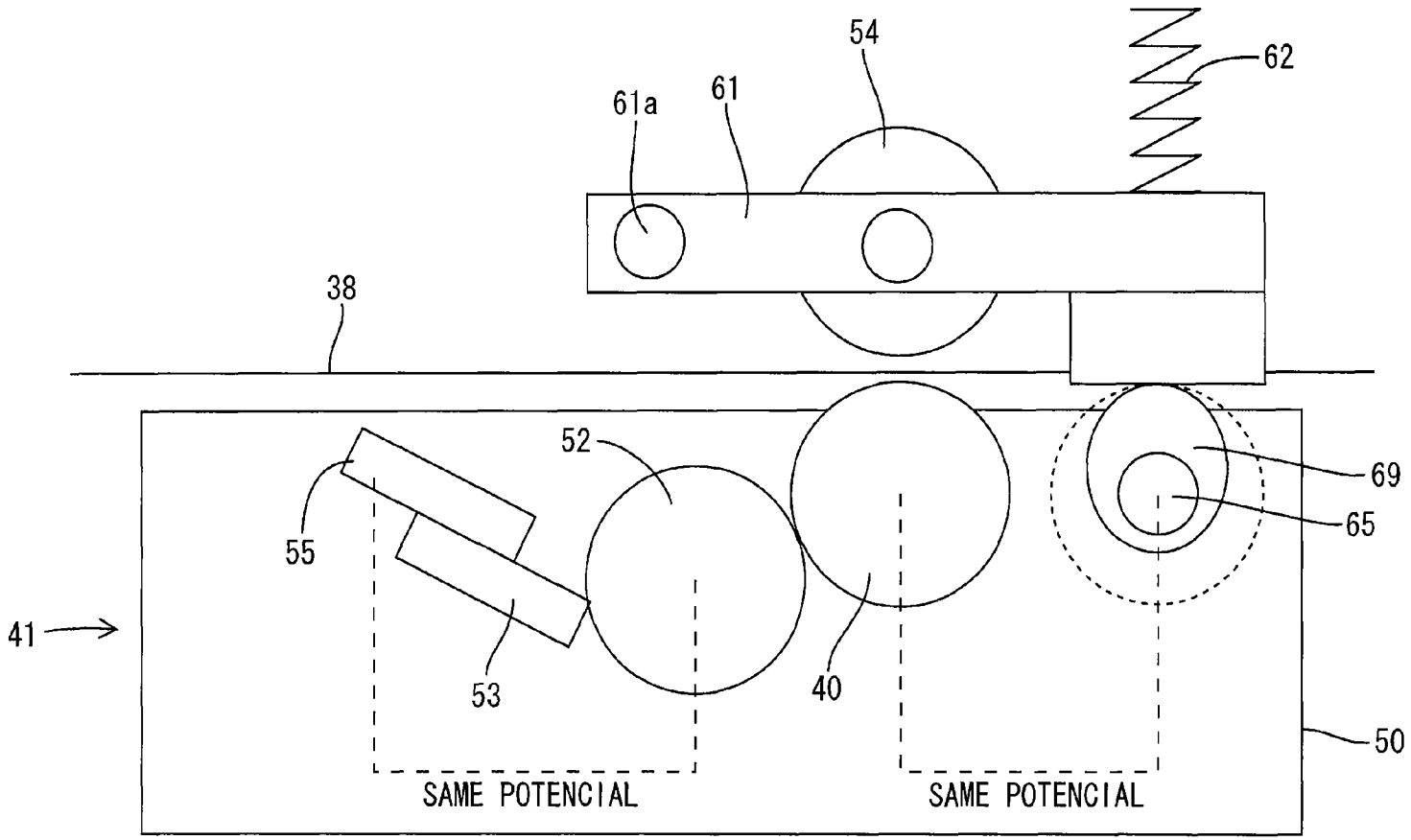
FIG. 5 is a schematic view (separation state) of the belt cleaning unit and the pressing force changing mechanism.
Figure 6:
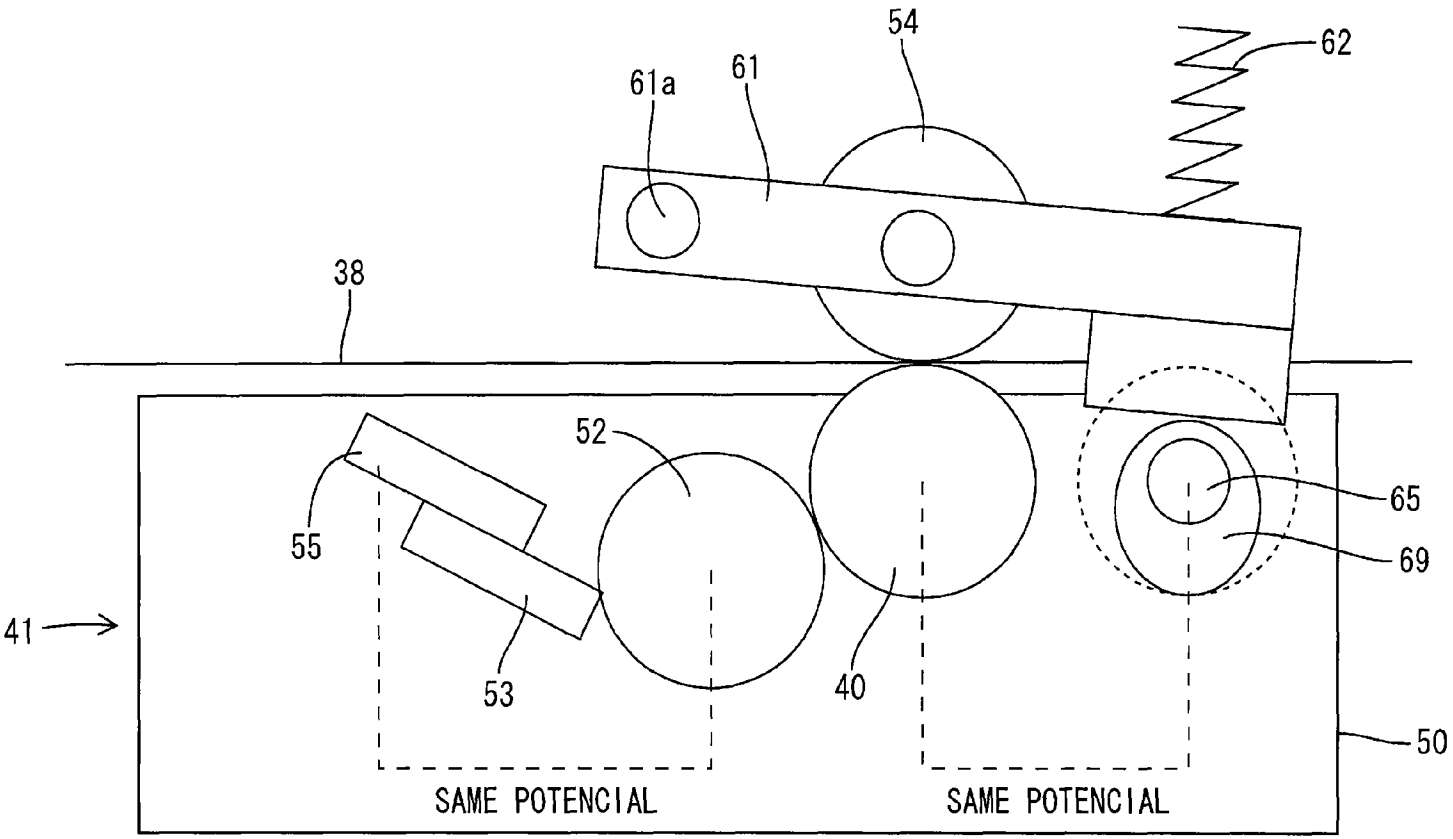
FIG. 6 is a schematic view (contact state) of the belt cleaning unit and the pressing force changing mechanism.

When a start command signal for a cleaning operation is sent to the solenoid switch in the separation state shown in FIGS. 3 and 5, engagement by the engaging arm 67 is released, and the gear 65*a* is meshed with the rotary gear 41*a* and is rotationally driven. Thereby, as shown in FIG. 6, each of the cams 69 has the large diameter portion faced downward, the tooth portions of the gear 65*a* are in the rotational position where they are opposed to the rotary gear 41*a* and are not meshed with it, and the metal shaft body 65 is brought into the state where it is held by the engaging arm 67 again. In this state, the end portions of the moveable holding arms 61 and 61 are pressed downward by the biasing force of the pressing spring 62, whereby the backup roller 54 is displaced to the contact position, and is brought into the contact state with the cleaning roller 40 and the transfer belt 38 therebetween. Thereafter, a start command signal for an image formation operation is sent to the solenoid switch again, and thereby, they are returned to the separation state in FIGS. 3 and 5. The metal shaft body 65 can be made of a metal in order to provide rigidity corresponding to the forces which are loaded respectively to move the cams 69 and 69 in synchronism with it in the operation of the above described pressing force changing mechanism 60.

As described above, at the time of a cleaning operation, the transfer belt 38 is in positioned between or in moveable contact with the backup roller 54 and the cleaning roller 40, and during an image forming operation such as transfer and fusing to the paper 3, the backup roller 54 and the cleaning roller 40 are separated from the transfer belt 38. Accordingly, the turning load of the transfer belt 38 during an image forming operation is reduced to make stable movement of the paper 3 possible, and deterioration of the cleaning roller 40 by contact with the transfer belt 38 in the state where contact pressure occurs can be reduced.

<Construction for Eliminating Backlash and Preventing Current Leak of Belt Cleaning Unit>

As shown in FIGS. 3 and 4, in the belt cleaning unit 41, a pair of columnar front side support protruded parts 70 and 70 are positioned on a left and a right side surfaces of the front end side of the case 50, and a pair of columnar rear side support protruded parts 71 and 71 are positioned on a left and a right side surfaces at the rear end side of the case 50. Meanwhile, front side support members 72 and 72 which receive the respective front side support protruded parts 70 and 70, and rear side support members 73 and 73 which receive the rear side support protruded parts 71 and 71 are fixed and positioned at left and right opposing walls of the unit housing 19 of the body casing 2. Each of the front side support members 72 is formed into a U-shape opened upward in section, and each of the front side support protruded parts 70 is housed therein. Each of the rear side support members 73 is formed into an L-shape opened upward and forward in section, and the rear side support protruded part 71 is mounted on its bottom surface.

Figure 7:
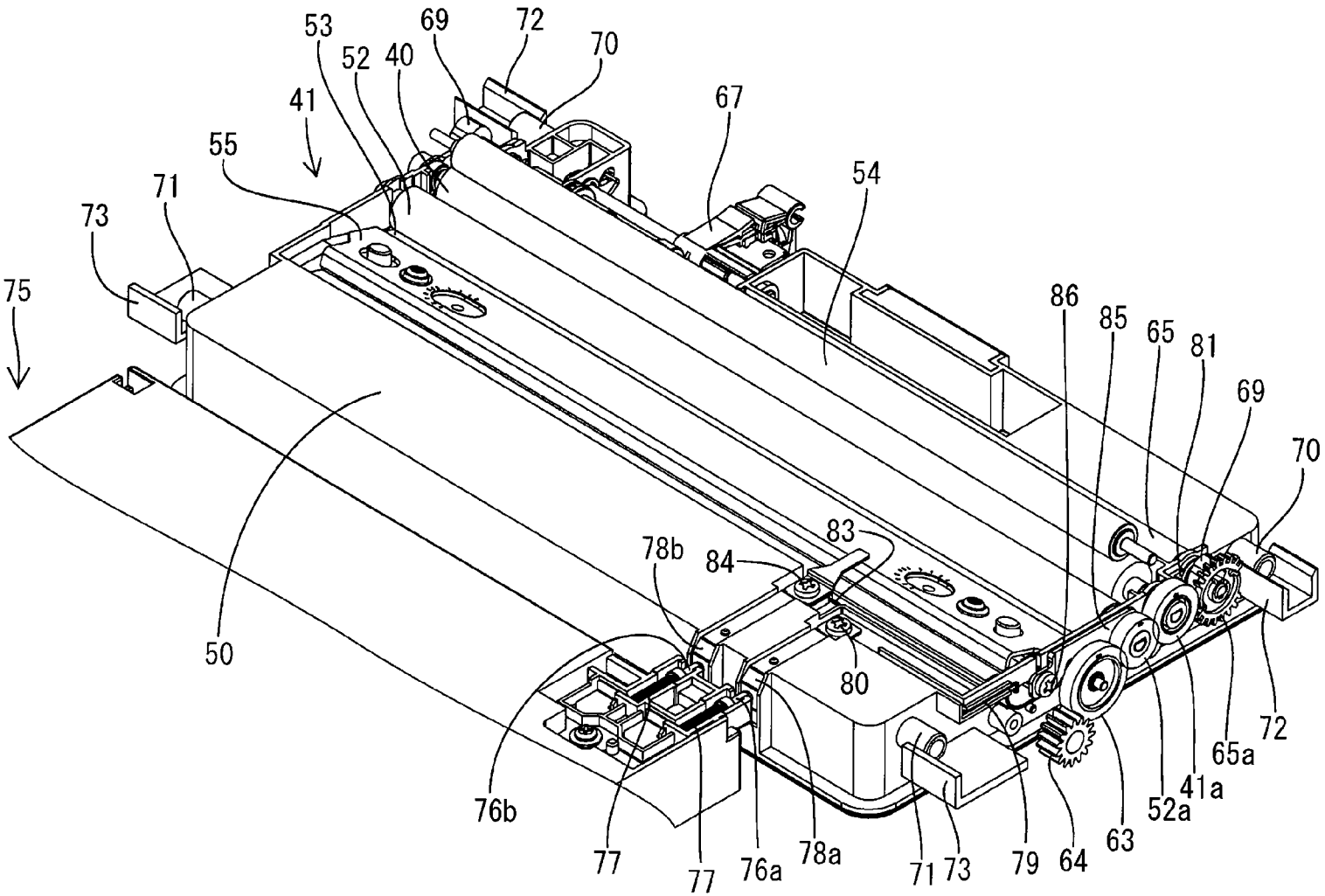
FIG. 7 is a perspective view showing the belt cleaning unit and a part of a bias supply part.
Figure 8:
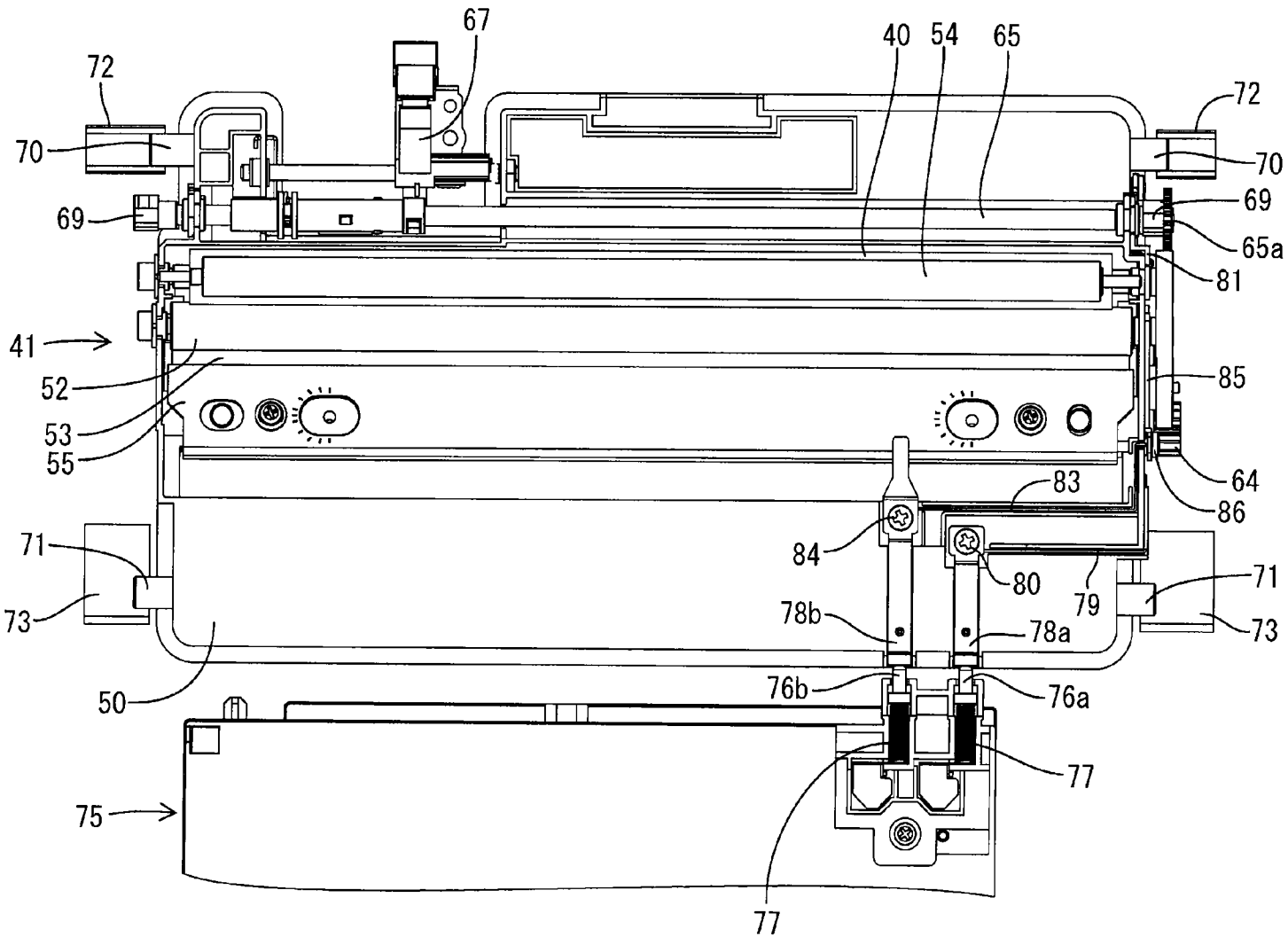
FIG. 8 is a top view showing the belt cleaning unit and a part of the bias supply part.

FIG. 7 is a perspective view showing the belt cleaning unit 41 and a part of a bias supply part 75 (the front side of the laser printer 1 is in the upper right direction of the paper surface in the drawing). FIG. 8 is a top view showing the belt cleaning unit 41 and a part of the bias supply part 75 (the front side of the laser printer 1 is in the upper direction of the paper surface in the drawing). In FIGS. 7 and 8, illustration of the transfer belt 38 is omitted as in FIG. 3.

As shown in FIGS. 7 and 8, the bias supply part 75 is fixed and disposed behind the belt cleaning unit 41 mounted inside the body casing 2. In the bias supply part 75, a pair of output terminals 76*a* and 76*b* are positioned laterally side by side at its front surface (for example, at the position to the left in this illustrative aspect) and can be formed into rod-like shapes. Biasing springs 77 and 77, which function as biasing mechanisms which bias the output terminals 76*a* and 76*b* forward, are respectively positioned at their base end sides. The output terminal 76*a* outputs the above described negative polarity bias to the cleaning roller 40, and the output terminal 76*b* outputs the above described negative polarity bias to the metal roller 52.

Meanwhile, in the belt cleaning unit 41, a pair of input terminals 78*a* and 78*b* are positioned laterally side by side at the rear surface of the case 50 (the position to the left in this illustrative aspect). Each of the input terminals 78*a* and 78*b* can be configured as a metal member in a long plate shape folded in an L-shape to turn onto the top surface from the rear surface of the case 50. Both of the input terminals 78*a* and 78*b* can be positioned inside the groove formed on the case 50, and in the position recessed lower than the outer surface of the case 50 around it. In the state in which the belt cleaning unit 41 is mounted inside the body casing 2, the input terminal 78*a* is in contact with the above described output terminal 76*a*, and hathes in the transfer of the negative polarity bias to the cleaning roller 40. Further, the input terminal 78*b* is in contact with the above described output terminal 76*b*, and hathes in the transfer of the negative polarity bias to the metal roller 52.

Figure 9:
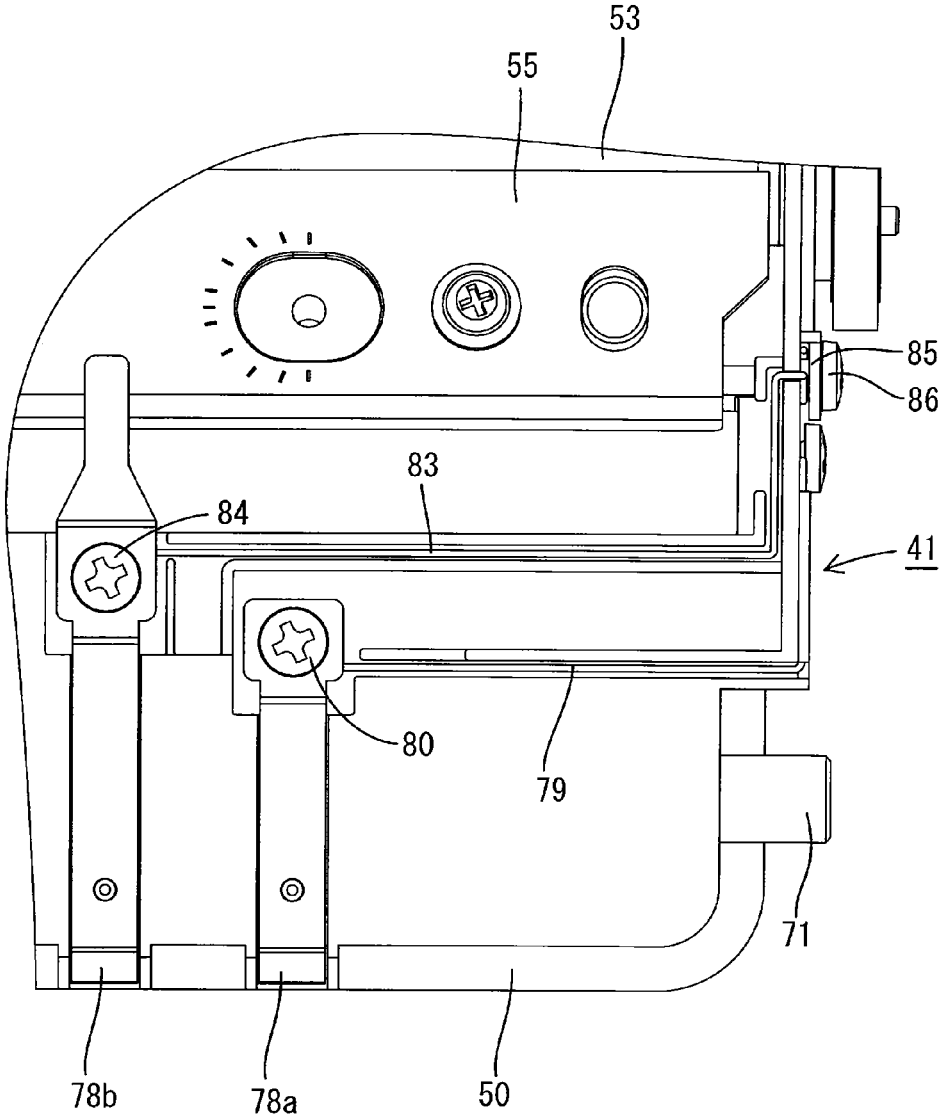
FIG. 9 is a top view of an enlarged input terminal portion of the belt cleaning unit.
Figure 10:
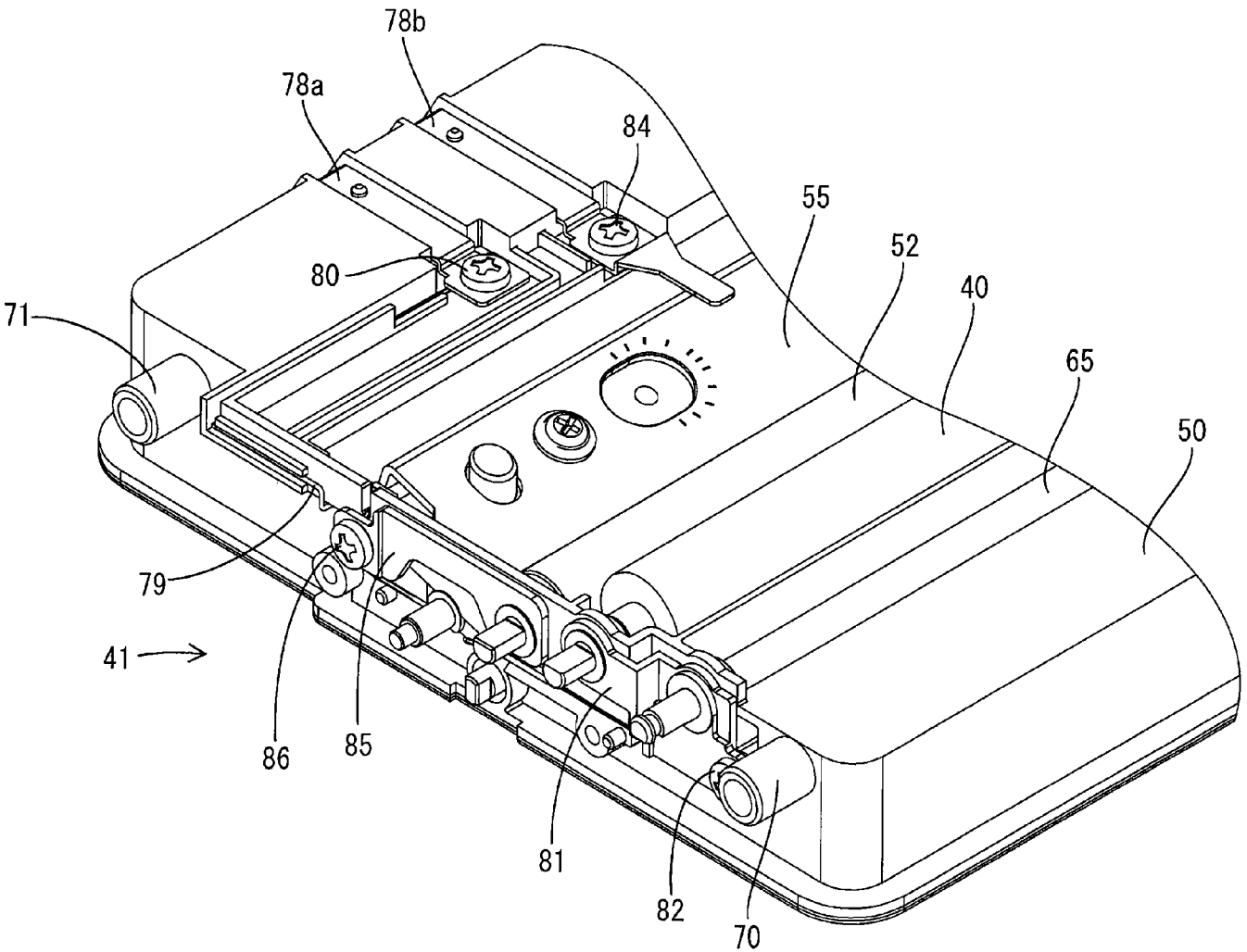
FIG. 10 is a perspective view of the enlarged input terminal portion of the belt cleaning unit.

FIG. 9 is a top view of the enlarged input terminal portion of the belt cleaning unit 41 (the front side of the laser printer 1 is in the upper direction of the paper surface of the drawing). FIG. 10 is a perspective view of the enlarged input terminal portion of the belt cleaning unit 41 (the front side of the laser printer 1 is in the diagonally lower right direction of the paper surface of the drawing).

In the input terminal 78*a*, its front end portion is fastened to the case 50 with a screw 80 with one end portion of a lead wire 79 positioned therebetween. As shown in FIG. 10, the rotary shaft of the cleaning roller 40 and the metal shaft body 65 are received by a common shaft-receiving member 81 formed by a conductive plastic (synthetic resin or the like). The shaft-receiving member 81 is fastened to the case 50 via screw 82 with the other end portion of the above described lead wire 79 positioned therebetween. By such a construction, the negative polarity bias from the input terminal 78*a* is transferred to the roller shaft of the cleaning roller 40 via the lead wire 79 and the shaft-receiving member 81, and the metal shaft body 65 is made at the same potential as the roller shaft of the cleaning roller 40 by the shaft-receiving member 81. Accordingly, the shaft-receiving member 81 is one example of "the first short-circuiting connection member". The case 50 of the belt cleaning unit 41 is constructed by a plastic (synthetic resin or the like) having insulating properties as a matter of course.

The front end portion of input terminal 78*b* is in contact with the holder 55, and is fastened to the case 50 with a screw 84 with one end portion of a lead wire 83 positioned therebetween. The roller shaft of the metal roller 52 is received by a shaft-receiving member 85 formed by a conductive plastic (synthetic resin or the like), and the shaft-receiving member 85 is fastened to the case 50 via screw 86 with the other end portion of the above described lead wire 83 positioned therebetween. By such a construction, the negative polarity bias from the input terminal 78*b* is transferred to the roller shaft of the metal roller 52 via the lead wire 83 and the shaft-receiving member 85, and the negative polarity bias from the input terminal 78*b* is directly applied to the holder 55, thus making the roller shaft of the metal roller 52 and the holder 55 at the same potential. Accordingly, the lead wire 83 and the shaft-receiving member 85 are one example of "the second short-circuiting connection member".

<Effect of the Illustrative Aspect>

(1) Since the rotary shaft of the cleaning roller 40 and the metal shaft body 65 are made at the same potential, occurrence of current leak is prevented, and both of them can be positioned close to each other. Here, as the rotary shaft of the cleaning roller 40 and the metal shaft body 65 are farther away from each other, the arm length of the moveable holding arm 61 from the support shaft body 61*a* becomes larger, and the cam which abuts on its end portion cannot displace the backup roller 54 between the above described separation position and the contact position unless the diameter of the cam is made larger. On the other hand, in this illustrative aspect, the rotary shaft of the cleaning roller 40 and the metal shaft body 65 can be positioned close to each other, the backup roller 54 can be displaced between the separation position and the contact position with the cam 69 having the relatively small diameter. Since the roller shaft of the metal roller 52 and the holder 55 are made at the same potential, occurrence of current leak is prevented, and they can be positioned close to each other. Thus, a smaller protrusion length of the scraping blade 53 from the holder 55 can be realized, and the residual toner T adhering to the metal roller 52 can be scraped off by the stable pressure contact. From the above, reduction in size of the belt cleaning unit 41, and reduction in size of the entire laser printer 1 can be achieved.

(2) The belt cleaning unit 41 is supported by the front side support member 72 and the rear side support member 73 as described above. However, the front side support member 72 requires a certain degree of clearance with respect to the front side support protruded portion 70 for making the belt cleaning unit 41 attachable and detachable. Because of this, there is the fear that the belt cleaning unit 41 cannot clean the transfer belt 38 with high backlash precision only utilizing the front side support members 72 and the rear side support members 73. This is especially true when the roller shaft of the cleaning roller 40 inclines relative to the traveling direction of the transfer belt 38, thus arising the possibility of applying a skew force to the transfer belt 38 to make it meander. In this case, a certain amount of pressure is needed to provide reliable electrical connection of the output terminals 76*a* and 76*b* and the input terminals 78*a* and 78*b*. Thus, in this illustrative aspect, the biasing force (the dotted line arrow X1 in FIG. 4) of the biasing springs 77, which bias the output terminals 76*a* and 76*b*, is used for securing the contact pressure. Thus, elimination of backlash of the belt cleaning unit 41 with respect to the body casing 2 and the transfer belt 38 is realized.

The belt cleaning unit 41 receives a rotational force of the output gear 64, which is connected to the input gear 63 and receives a force in the diagonally lower direction to the front side, namely, a force in the direction (the dotted line arrow X2 in FIG. 4) with the pressure angle considered with respect to the tangential line at the meshing position of the input gear 63 and the output gear 64. Further, the belt cleaning unit 41 receives the reaction force (the dotted line arrow X3 in FIG. 4) from the cleaning roller 40 rotationally driven in contact with and opposed to the transfer belt 38 at the time of a cleaning operation. Accordingly, by the resultant force of these three forces X1, X2 and X3, the belt cleaning unit 41 is strongly pressed against a front wall 72*a* (one example of "an opposing portion") of the front side support member 72, and thereby, backlash of the belt cleaning unit 41 can be reliably suppressed. The belt cleaning unit 41 is pressed against the bottom surfaces of the front side support members 72 and the rear side support members 73 by the component force in the lower direction of the force X2 and the biasing force of the pressing spring 62, and thereby, the belt cleaning unit 41 is positioned in the vertical direction.

<Other Illustrative Aspects>

The present invention is not limited to the illustrative aspect described in accordance with the above description and the drawings, but, for example, the following illustrative aspects are also included in the technical range of the present invention.

(1) In the above described illustrative aspects, the biasing springs 77 which bias the output terminals 76*a* and 76*b* are used as the biasing mechanism, but the biasing mechanism is not thus limited. A construction in which the output terminals themselves are formed by a metal plate spring material, and the output terminals are pressed against the input terminals 78*a* and 78*b* with the elastic force of this plate spring material may be adopted.

(2) Unlike the above described illustrative aspects, the construction in which the output terminals 76*a* and 76*b* are fixedly disposed, the front wall 72*a* corresponding to the opposing part is made longitudinally movable, and a biasing mechanism which biases the front wall 72*a* rearward (to the output terminals 76*a* and 76*b* side) is provided may be adopted. Alternatively, the construction in which the output terminals 76*a* and 76*b* and the front wall 72*a* are fixedly disposed, and a biasing mechanism, which biases the input terminals 78*a* and 78*b* rearward (to the output terminals 76*a* and 76*b* side), is positioned at the belt cleaning unit 41 may be adopted.

(3) In the above described illustrative aspects, the construction in which the cleaning roller 40 is rotationally driven in contact with and opposed to the transfer belt 38 is adopted, but the present invention is not limited to this. Even if the cleaning roller 40 is rotationally driven in the same direction as the transfer belt 38 with a difference in circumferential speed (for example, at a low speed) with respect to the transfer belt 38, substantially the same positioning effect as in the above described illustrative aspect can be obtained.

What is claimed is:

1. An image forming apparatus comprising:

an apparatus body including an opening;

a belt which is disposed inside the apparatus body and is moveable therein;

a power supply circuit generating bias voltage;

an output terminal which is provided inside the apparatus body and aids in the transfer of a bias voltage of the power supply circuit; and a belt cleaning unit constructed to be attachable to and detachable from the apparatus body via the opening, the belt cleaning unit having an input terminal and a cleaning member, the input terminal positioned at a first end side of the belt cleaning unit;

wherein the input terminal is in electrical contact with the output terminal; and wherein the apparatus body further includes:

an opposing part which is positioned at a side opposite to the output terminal; and a biasing mechanism which applies a biasing force to elastically hold the cleaning unit between the opposing part and the output terminal.

2. The image forming apparatus according to claim 1, wherein the opposing part is fixed to a predetermined position inside the apparatus body, and the biasing mechanism biases the output terminal to the opposing part side.

3. The image forming apparatus according to claim 2,
wherein the cleaning member is a cleaning roller which is capable of contacting the belt, the cleaning roller being rotationally driven in the same direction as a moving direction of the belt so that the cleaning roller is in contact at a lower speed than a moving speed of the belt, or the cleaning roller being rotationally driven in a direction opposed to the moving direction of the belt;
wherein the input terminal is positioned at an end portion of the belt cleaning unit;
wherein the end portion is positioned at an upstream side in the moving direction of the belt; and
wherein the opposing part is disposed at and opposed to an downstream side of the output terminal in the moving direction of the belt.

4. The image forming apparatus according to claim 3, further comprising:
an output gear which is positioned inside the apparatus body and is rotationally driven by receiving a drive force,
wherein the belt cleaning unit further comprises an input gear which is connected to the output gear and rotationally drives the cleaning roller, and
wherein the opposing part receives a force applied to the belt cleaning unit via the input gear by the drive force of the output gear.

5. The image forming apparatus according to claim 4,
wherein in an insertion direction of the belt cleaning unit from the opening, the opposing part is disposed at an opening side relative to the output gear; and
wherein the output gear is disposed at a position to be connected to the input gear of the belt cleaning unit disposed inside the apparatus body diagonally from a front side in the insertion direction, and the output gear is rotationally driven in a direction in which a connected portion with the input gear faces the opposing part side.

6. The image forming apparatus according to claim 2, further comprising:
an output gear which is positioned inside the apparatus body and is rotationally driven by a drive force;
wherein the cleaning member includes a cleaning roller and an input gear, the cleaning roller being capable of contacting the belt, and the input gear being connected to the output gear and rotationally driving the cleaning roller; and
wherein the opposing part receives a force applied to the belt cleaning unit via the input gear by the drive force of the output gear.

7. The image forming apparatus according to claim 6,
wherein in an insertion direction of the belt cleaning unit from the opening, the opposing part is disposed at an opening side relative to the output gear;
wherein the output gear is disposed at a position to be connected to the input gear of the belt cleaning unit disposed inside the apparatus body diagonally from a front side in an insertion direction, and the output gear is rotationally driven in a direction in which a connected portion with the input gear moves toward the opposing part side.

8. An image forming apparatus comprising:
an apparatus body including an opening;
a belt which is disposed inside the apparatus body and is moveable therein;
a power supply circuit generating bias voltage;
an output terminal which is provided inside the apparatus body and aids in the transfer of a bias voltage of the power supply circuit; and
a belt cleaning unit constructed to be attachable to and detachable from the apparatus body via the opening;
wherein the belt cleaning unit includes
an input terminal positioned at a first end side of the belt cleaning unit; and
a cleaning member which is electrically connected to the input terminal; and
wherein the apparatus body further comprises a biasing mechanism which applies a biasing force by which the output terminal elastically contacts the input terminal.

9. The image forming apparatus according to claim 8,
wherein the cleaning member is a cleaning roller which is capable of contacting the belt, the cleaning roller being rotationally driven in the same direction as a moving direction of the belt so that the cleaning roller is in contact at a lower speed than a moving speed of the belt, or the cleaning roller being rotationally driven in a direction opposed to the moving direction of the belt;
wherein the input terminal is positioned at an end portion of the belt cleaning unit; and
wherein the end portion is positioned at an upstream side in the moving direction of the belt.

10. The image forming apparatus according to claim 9, further comprising:
an output gear which is disposed inside the apparatus body and is rotationally driven by a drive force; and
wherein the belt cleaning unit includes:
a cleaning roller capable of contacting the belt; and
an input gear which is capable of being connected to the output gear and rotationally driving the cleaning roller.

11. The image forming apparatus according to claim 8, further comprising:
an output gear which is positioned inside the apparatus body and is rotationally driven by receiving a drive force; and
wherein the belt cleaning unit includes:
a cleaning roller capable of contacting the belt; and
an input gear which is capable of being connected to the output gear and rotationally driving the cleaning roller.

12. An image forming apparatus comprising:
an apparatus body having a unit housing;
a belt which is disposed inside the apparatus body and is moveable therein;
a belt cleaning unit which has a case and a cleaning roller supported by the case, said belt cleaning unit being capable of cleaning the belt,
wherein the unit housing includes a support part,
wherein the belt cleaning unit includes a support protruded part,
wherein the support protruded part is in contact with the support part so that the belt cleaning unit is detachably supported relative to the unit housing,
wherein the unit housing is provided with a first output terminal via a first biasing member, and is provided with a second output terminal via a second biasing member,
wherein the case of the belt cleaning unit includes:
a metal roller which is in contact with the cleaning roller;
a first input terminal electrically connected to the cleaning roller and elastically in contact with the first output terminal by a biasing force of the first biasing member; and
a second input terminal electrically connected to the metal roller and elastically in contact with the second output terminal by a biasing force of the second biasing member, and wherein a composite force including a force which the first input terminal receives from the first output terminal, and a force which the second input terminal receives from the second output terminal, and a pressing force which presses the belt cleaning unit against the support part are directed in substantially the same direction.

13. The image forming apparatus according to claim 12, wherein the unit housing includes an output gear which is rotationally driven by a drive force;

wherein the belt cleaning unit includes an input gear which is capable of being connected to the output gear and rotationally drives the cleaning roller; and wherein a force applied to the belt cleaning unit via the input gear by a drive force of the output gear, and a the pressing force which presses the belt cleaning unit against the support part are directed in substantially the same direction.

14. The image forming apparatus according to claim 12, wherein the cleaning roller electrostatically attracts an extraneous matter on the belt surface by having bias voltage applied thereto.

* * * * *

UNITED STATES PATENT AND TRADEMARK OFFICE

CERTIFICATE OF CORRECTION

PATENT NO. : 7,937,017 B2
APPLICATION NO. : 11/614544
DATED : May 3, 2011
INVENTOR(S) : Hirotaka Mori It is certified that error appears in the above-identified patent and that said Letters Patent is hereby corrected as shown below:

In Column 18, Claim 13, Line 2-3:

Please replace “a the pressing” with --the pressing--

Signed and Sealed this
Fourteenth Day of February, 2012

David J. Kappos

David J. Kappos
*Director of the United States Patent and Trademark Office*